US006784212B2

(12) United States Patent
Steynberg et al.

(10) Patent No.: US 6,784,212 B2
(45) Date of Patent: Aug. 31, 2004

(54) PRODUCTION OF LIQUID HYDROCARBON PRODUCTS

(75) Inventors: Andre Steynberg, Vanderbijlpark (ZA); Simon Charles Clarke, Redding (GB)

(73) Assignee: Sasol Technology (Proprietary) Limited, Johannesburg (ZA)

( * ) Notice: Subject to any disclaimer, the term of this patent is extended or adjusted under 35 U.S.C. 154(b) by 71 days.

(21) Appl. No.: 10/178,386

(22) Filed: Jun. 24, 2002

(65) Prior Publication Data

US 2004/0077736 A1 Apr. 22, 2004

Related U.S. Application Data

(63) Continuation of application No. PCT/IB01/02103, filed on Nov. 8, 2001.

(30) Foreign Application Priority Data

Nov. 10, 2000 (GB) ..... 0027575

(51) Int. Cl.[7] ..... C07C 27/00

(52) U.S. Cl. ..... 518/700; 518/703; 518/704; 518/715; 518/722; 518/702

(58) Field of Search ..... 518/700, 702, 518/703, 704, 715, 722

(56) References Cited

U.S. PATENT DOCUMENTS

| | | | | |
|---|---|---|---|---|
| 4,579,985 A | | 4/1986 | Minderhoud et al. | 585/310 |
| 4,587,008 A | | 5/1986 | Minderhoud et al. | 208/109 |
| 4,833,170 A | | 5/1989 | Agee | 518/703 |
| 5,620,670 A | | 4/1997 | Benham et al. | 422/213 |
| 6,248,794 B1 | * | 6/2001 | Gieskes | 518/700 |
| 6,313,361 B1 | * | 11/2001 | Waycuilis | 585/314 |

FOREIGN PATENT DOCUMENTS

| | | |
|---|---|---|
| EP | 0516441 | 12/1992 |
| EP | 0516441 A1 | 12/1992 |
| EP | 0516441 | 4/1998 |
| GB | 780577 | 8/1957 |
| GB | 1439769 | 6/1976 |
| GB | 2149813 | 6/1985 |
| GB | 2223029 | 3/1990 |
| GB | 2246576 A | 2/1992 |
| WO | 0142175 | 6/2001 |

OTHER PUBLICATIONS

Hansen, R., et al. "Selecting optimum syngas technology and process design for large scale conversion of natural gas into Fischer–Tropsch products (GTL) and Methanol", pp. 405–410. *Studies in Surface Science and Catalysis*, J.J. Spivey, E. Iglesia and T.H. Fleisch (Editors), © 2001 Elsevier Science B.V.

* cited by examiner

*Primary Examiner*—J. Parsa
(74) *Attorney, Agent, or Firm*—Ladas & Parry

(57) ABSTRACT

A process for producing liquid hydrocarbon products includes converting a natural gas feedstock to synthesis gas, which is reacted, in a hydrocarbon synthesis stage and by a Fischer-Tropsch reaction, to produce a range of hydrocarbon product. An overheads vapour phase is separated from a liquid phase, and fed to a product condensation stage, where condensation of some components thereof takes place. A vapour phase, an aqueous phase, and a condensed product phase are withdrawn. The vapour phase is fed to a vapour phase work-up stage where a gas component comprising increased concentrations of CO and H2, relative to the vapour phase feed to the vapour phase work-up stage, is recovered, with this gas component being recycled to the hydrocarbon synthesis stage.

13 Claims, 2 Drawing Sheets

PRODUCTION OF LIQUID HYDROCARBON PRODUCTS

This application is a continuation of PCT/IB01/02103 filed Nov. 8, 2001.

FIELD OF INVENTION

THIS INVENTION relates to the production of liquid hydrocarbon products. It relates in particular to a process for producing liquid hydrocarbon products.

SUMMARY OF INVENTION

According to a first aspect of the invention, there is provided a process for producing liquid hydrocarbon products, which process includes converting, in a synthesis gas production stage, a natural gas feedstock comprising mainly $CH_4$ to synthesis gas, comprising CO, $H_2$, $CO_2$ and $CH_4$;

feeding the synthesis gas, as a feedstock, to a hydrocarbon synthesis stage;

in the hydrocarbon synthesis stage, reacting the synthesis gas at elevated temperature and pressure, and in the presence of a Fischer-Tropsch catalyst, to produce a range of hydrocarbon products of differing carbon chain lengths and separating an overheads vapour phase comprising gaseous hydrocarbon products, unreacted synthesis gas, water, and any soluble organic compounds which form in the hydrocarbon synthesis stage, from a liquid phase comprising heavier liquid hydrocarbon products;

withdrawing the liquid phase from the hydrocarbon synthesis stage;

withdrawing the overheads vapour phase from the hydrocarbon synthesis stage and feeding it to a product condensation stage, where condensation of at least some components of the overheads vapour phase takes place;

withdrawing from the product condensation stage a vapour phase comprising gaseous hydrocarbon products, an aqueous phase comprising water and said any soluble organic compounds which form in the hydrocarbon synthesis stage, and a condensed product phase comprising condensed hydrocarbon products;

feeding the vapour phase to a vapour phase work-up stage;

in the vapour phase work-up stage, recovering from the vapour phase a gas component comprising increased concentrations of CO and $H_2$, relative to the vapour phase feed to the vapour phase work-up stage; and recycling the CO and $H_2$-containing gas component to the hydrocarbon synthesis stage, as a feedstock component.

The conversion of the natural gas to synthesis gas in the synthesis gas production stage may be effected by any suitable reaction mechanism involving reacting hydrocarbonaceous material, which is primarily $CH_4$, in the natural gas with steam and/or oxygen. Typically, the conversion may be effected by means of steam reforming, which does not require the use of oxygen; autothermal reforming, in which the hydrocarbonaceous material reacts with oxygen in a first reaction section, whereafter an endothermic steam reforming reaction takes place adiabatically in a second reaction section; ceramic oxygen transfer membrane reforming, in which oxygen required for the reforming reaction is transported through an oxygen permeable membrane into a reaction zone; plasma reforming in which the reforming reaction is driven by an electrically generated plasma; non-catalytic partial oxidation; or catalytic partial oxidation. If desired, two or more of these conversion mechanisms or technologies may be combined, eg to optimize thermal efficiency, or to obtain an optimised or beneficial synthesis gas composition.

The present invention is characterized thereby that it is not necessary to remove $CO_2$ from the synthesis gas before using it as feedstock to the hydrocarbon synthesis stage.

The hydrocarbon synthesis stage may include a suitable reactor such as a tubular fixed bed reactor, a slurry bed reactor or an ebullating bed reactor. The pressure in the reactor may be between 1 and 100 bar, while the temperature may be between 200° C. and 380° C. The reactor will thus contain the Fischer-Tropsch catalyst, which will be in particulate form. The catalyst may contain, as its active catalyst component, Co, Fe, Ni, Ru, Re and/or Rh. The catalyst may be promoted with one or more promoters selected from an alkali metal, V, Cr, Pt, Pd. La, Re, Rh, Ru, Th, Mn, Cu, Mg, Zn and Zr. The catalyst may typically be a supported catalyst, in which the active catalyst component, eg Co, is supported on a suitable support. The support may be $Al_2O_3$, $TiO_2$, $SiO_2$ or a combination of these.

In the hydrocarbon synthesis stage, the synthesis gas is thus catalytically reacted by means of so-called Fischer-Tropsch synthesis. Thus, for example, low temperature Fischer-Tropsch synthesis with a co-based catalyst may be used. The reaction temperature will then typically be in the range of 200° C. to 260° C. A Co-based catalyst does not exhibit any significant water gas shift activity. Thus, in low temperature Fischer-Tropsch synthesis using a Co-based catalyst, the main reactants are $H_2$ and CO, with $CO_2$ in the synthesis gas behaving as an inert gas in the hydrocarbon synthesis stage.

The condensed product phase that is withdrawn from the product condensation stage typically comprises hydrocarbon products having 3 or more carbon atoms.

In the vapour phase work-up stage, the vapour phase may be separated into the gas component comprising the increased concentrations of CO and $H_2$ (hereinafter also referred to as the 'first gas component'), a second gas component enriched in $CH_4$, and, optionally, a third gas component comprising mainly $CO_2$.

In one embodiment of the invention, the third gas component may be present. The vapour phase work-up stage may then include a $CO_2$ removal step in which the third gas component is removed from the vapour phase, and a subsequent cryogenic separation step to which the residual vapour phase is subjected and in which the first gas component is cryogenically separated from the second gas component.

In another embodiment of the invention, the vapour phase work-up stage may include a heavy ends recovery step in which hydrocarbon products having 3 or more carbon atoms, and which are present in the vapour phase, are removed from the vapour phase; the residual vapour phase may then pass to a subsequent pressure swing adsorption step where it is separated into the first and second gas components, and, optionally, the third gas component. The third gas component, when present, will comprise mainly $CO_2$ and some light hydrocarbon products.

When present, the third gas component may be used as a fuel gas, for example, in the synthesis gas production stage and/or for superheating process steam and other uses.

The second gas component may be used to satisfy any remaining fuel gas demand; optionally, as a feedstock to a hydrogen production stage in which hydrogen is produced from $CH_4$; and, optionally, in the synthesis gas production stage.

When hydrogen is produced from the second gas component, it may be added to the synthesis gas feedstock to the hydrocarbon synthesis stage, thereby to increase the synthesis gas hydrogen content. Instead, or additionally, hydrogen thus obtained may be used to upgrade the liquid hydrocarbon products produced in the hydrocarbon synthesis stage, as described in more detail hereunder.

An advantage of using the second gas component for hydrogen production, is that no treatment thereof is required for the removal of sulphur therefrom, since the second gas component is sulphur free.

The remainder of the second gas component, ie any residual second gas component not required for fuel gas or for hydrogen production, may be recycled as a feedstock component to the synthesis gas production stage. However, it will then be necessary to compress the gas to the same pressure as the natural gas feedstock to the synthesis gas preparation stage. Since the second gas component may still contain some $CO_2$, CO and $H_2$, it is less desirable for use as a feedstock component in the synthesis gas production stage.

The process may further include, in a liquid product upgrading stage, upgrading the liquid hydrocarbon products in the liquid phase withdrawn from the hydrocarbon synthesis stage as well as the hydrocarbon products in the condensed product phase from the product condensation stage. This upgrading may be effected by hydroprocessing the hydrocarbon products using hydrogen obtained from the second gas component as hereinbefore described, ie hydrogen produced in the hydrogen production stage.

According to a second aspect of the invention, there is provided a process for producing liquid hydrocarbon products, which process includes

- converting; in a synthesis gas production stage, a natural gas feedstock comprising mainly $CH_4$ to synthesis gas comprising CO, $H_2$, $CO_2$ and $CH_4$;
- without removal of $CO_2$, feeding the synthesis gas, as a feedstock, to a hydrocarbon synthesis stage;
- in the hydrocarbon synthesis stage, reacting the synthesis gas at elevated temperature and pressure, and in the presence of a Co-based Fischer-Tropsch catalyst, to produce a range of hydrocarbon products of differing carbon chain lengths, and separating a vapour phase comprising gaseous hydrocarbon products and unreacted synthesis gas from a liquid phase comprising heavier liquid hydrocarbon products;
- withdrawing the liquid phase from the hydrocarbon synthesis stage;
- withdrawing the vapour phase from the hydrocarbon synthesis stage and feeding it to a heavy ends recovery stage;
- in the heavy ends recovery stage, separating hydrocarbon products having 3 or more carbon atoms, from the vapour phase; and
- recycling at least a portion of the vapour phase from the heavy ends recovery stage to the synthesis gas production stage, as a feedstock component.

In the second aspect of the invention, the synthesis gas production stage and the hydrocarbon synthesis stage may be as hereinbefore described.

The invention will now be described by way of example with reference to the accompanying drawings.

DETAILED DESCRIPTION

Figure 1:
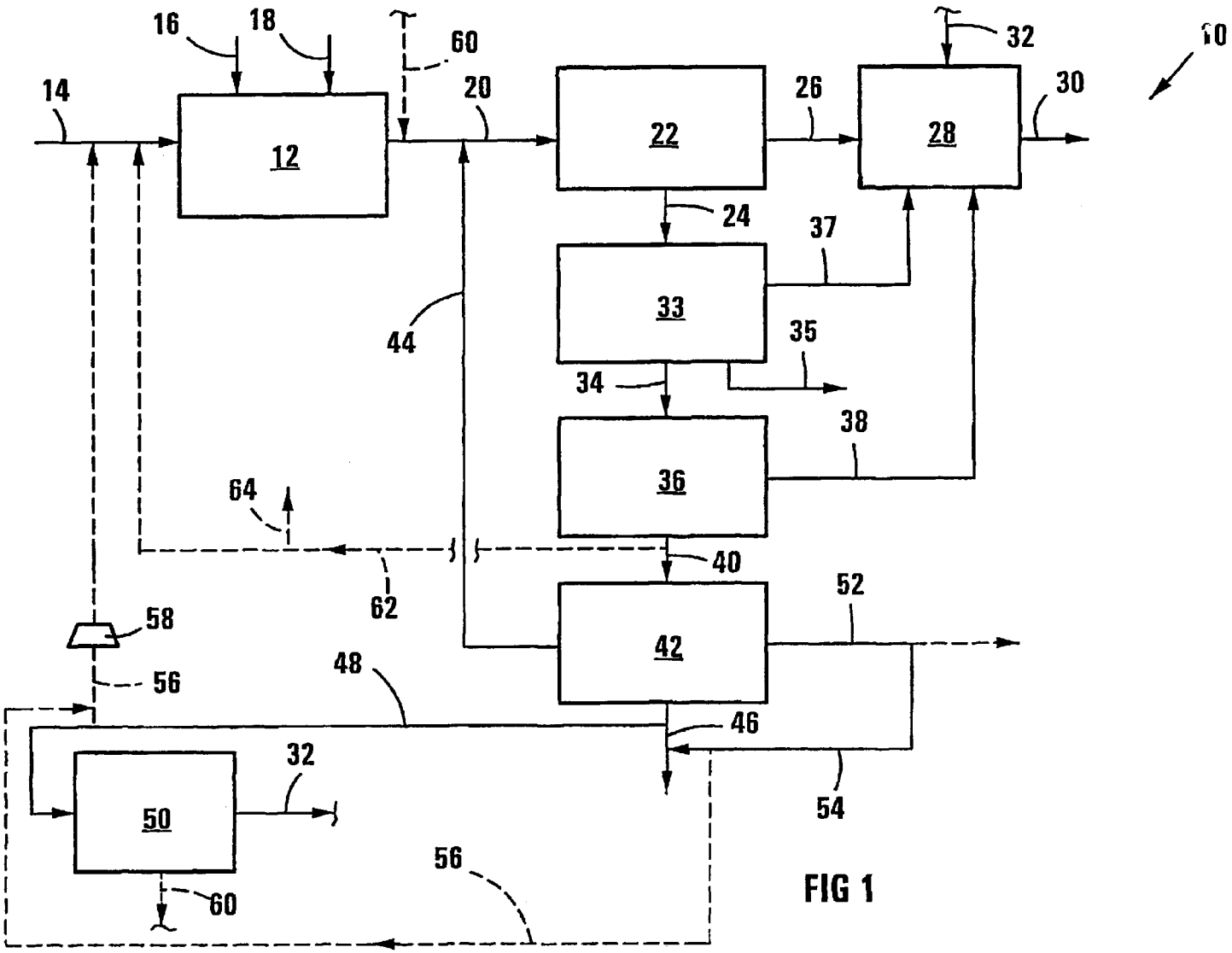
FIG. 1 shows a simplified flow diagram of a process according to one embodiment of the invention, for producing liquid hydrocarbon products.

Referring to FIG. 1, reference numeral 10 generally indicates a process according to one embodiment of the invention, for producing liquid hydrocarbon products.

The process 10 includes a synthesis gas production stage 12, with a natural gas feed line 14 leading into the stage 12. An oxygen feed line 16 also leads into the stage 12, as does a steam feed line 18.

A synthesis gas line 20 leads from the stage 12 to a hydrocarbon synthesis stage 22. A liquid phase withdrawal line 26 leads from the stage 22. The liquid phase withdrawal line 26 leads into a liquid product upgrading stage 28, with an upgraded product withdrawal line 30 leading from the stage 28. A hydrogen addition line 32 leads into the stage 28.

An overheads vapour phase withdrawal line 24 leads from the stage 22 to a product condensation stage 33. An aqueous phase withdrawal line 35 leads from the stage 33, as does a condensed product phase withdrawal line 37. The line 37 leads into the product upgrading stage 28.

A vapour phase withdrawal line 34 leads from the stage 33 to a heavy ends recovery step or stage 36. A light hydrocarbon withdrawal line 38 leads from the stage 36 to the stage 28. Instead, if desired the line 38 can lead to a separate product upgrading stage (not shown).

A vapour phase line 40 leads from the stage 36 to a pressure swing adsorption step or stage 42. A first gas component recycle line 44 leads from the stage 42 to the synthesis gas line 20.

A second gas component withdrawal line 46 leads from the stage 42. A line 48 leads from the line 46 to a hydrogen production stage 50, with the hydrogen line 32 leading from the stage 50. It will be appreciated that, if desired, the line 48 and the hydrogen production stage can be dispensed with.

A third gas component withdrawal line 52 leads from the stage 42, with a line 54 connecting the line 52 to the line 46, so that the third gas component produced in the stage 42 can also be used as fuel gas, as hereinafter described.

In use, natural gas is introduced along the line 14 into the synthesis gas production stage 12. Typically, the stage 12 is provided by an autothermal reformer in which hydrocarbonaceous material, mainly methane, present in the natural gas reacts with oxygen which enters the reformer through the line 16, in a first section of the reformer. Thereafter, endothermic steam reforming, using steam which enters along the line 18, occurs adiabatically in a second section of the reformer. The autothermal reformer typically uses a low steam to carbon ratio of about 0.2:1 to about 0.6:1, with the outlet gas temperature being from 1000° C. to 1100° C.

Synthesis gas comprising CO, $H_2$, $CO_2$ and some residual methane passes from the stage 12 along the flow line 20 to the hydrocarbon synthesis stage 12, 22. In the stage 22, $H_2$ and CO in the synthesis gas are reacted, at a temperature of 200° C. to 280° C., a pressure of between 1 and 100 bar, typically about 25 bar, and in the presence of a cobalt-based catalyst, using so-called low temperature Fischer-Tropsch synthesis, to produce a range of hydrocarbon products of differing carbon chain lengths. The products are separated into a liquid phase comprising heavier liquid hydrocarbons, and an synthesis gas, water and soluble organic compounds such as alcohols. The liquid phase is withdrawn along the line 26 to the product upgrading stage 28 where the liquid hydrocarbon products are upgraded by means of hydroprocessing into more valuable products, which are withdrawn along the The overheads vapour phase is withdrawn along the line 24 and passes into the product condensation unit 33. An aqueous phase comprising water and any soluble organic compounds is withdrawn along the line 35. A condensed product phase, typically comprising hydrocarbon products having 3 or more carbon atoms, is withdrawn along the line 37 and passes into the product upgrading stage 28.

A vapour phase is withdrawn along the line 34 and passes to the heavy ends recovery stage 36 where light hydrocarbon products having carbon numbers of 3 or more, ie having 3 or more carbon atoms, are separated out and withdrawn along the line 38. The residual vapour phase passes along the line to the pressure swing adsorption stage 42 where it is separated into a first gas component comprising mainly CO and $H_2$, a second gas component enriched in $CH_4$, and a third gas component comprising mainly $CO_2$. The first gas component is recycled, along the line 44, to the synthesis gas line 20.

The heavy ends recovery in the stage 36 may be provided by an oil absorber (typically using chilled oil) or by cooling the vapour phase to temperatures close to (but slightly above) the $CO_2$ solidification temperature. Use may also be made of temperature swing adsorption.

The second gas component is withdrawn along the line 46, and a portion thereof is used as fuel gas. A portion of the second gas component passes along the flow line 48 to the hydrogen production stage 50 where hydrogen is produced. The hydrogen is withdrawn along the line 32 and is used for upgrading the liquid products in the stage 28.

The third gas component is withdrawn along the line 52 and is routed, by means of the line 54, to the line 46 so that it is also used as fuel gas. In another version (not shown) of this embodiment of the invention, no third gas component is produced in the stage 42. The lines 52, 54 are then dispensed with.

If there is an excess of second gas component over and above that required as fuel gas and for hydrogen production, it can be recycled, along a flow line 56, to the natural gas flow line 14 to the synthesis gas production stage 12. Thus, it is then used as a feedstock component. However, it then requires compression in a compressor 58. Additionally, it may contain some $CO_2$, CO and $H_2$ so that it is less desirable to use the second gas component as a feedstock component to the synthesis gas production stage 12.

If desired, hydrogen produced in the stage 50 can be routed, along a flow line 60, to the synthesis gas flow line 20 leading to the hydrocarbon synthesis stage 22. In this fashion, the $H_2$:CO ratio in the synthesis gas feed to the stage 22 can be adjusted, if necessary, eg depending on the efficiency of the various separations and the reformer operating conditions in the stage 12.

In another version of the invention, instead of having the pressure swing adsorption stage 42 and the hydrogen production stage 50, the vapour phase from the heavy ends recovery stage 36 can be recycled to the synthesis gas preparation stage 12, by means of a recycle line 62, so that the vapour phase is used as a feedstock component. Some of the vapour phase can then be withdrawn, along a flow line 64, for use as fuel gas in the stages 12, 22.

If desired, a portion (not shown) of the vapour phase or tail gas from the hydrocarbon synthesis stage 22 can then be recycled, upstream of the heavy ends recovery stage 36, to the stage 22.

In the heavy ends recovery stage 36, any suitable physical separation method may be used. However, preferably, the removal of the light hydrocarbon products may involve cooling the vapour stream, at elevated pressure, to a temperature above the $CO_2$ solidification temperature at that pressure, and then separating a condensed liquid phase from an uncondensed vapour phase. The cooling can be performed by using, for example, a refrigeration cycle employing a suitable refrigerant. Alternatively, a turbo expander is used to provide a significant portion of the cooling duty. Temperature swing adsorption and oil adsorption are alternatives to cooling and condensation as hereinbefore described.

Figure 2:
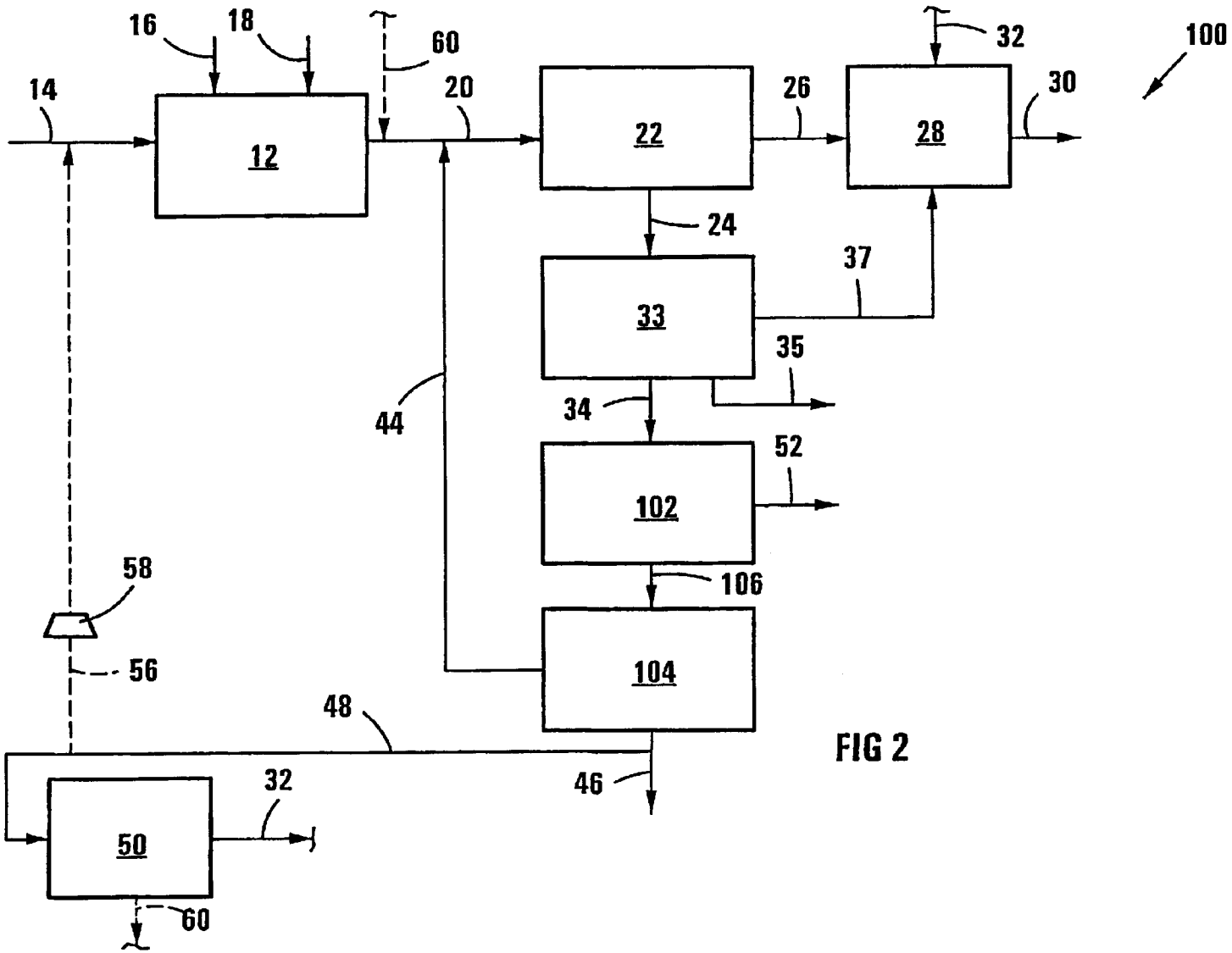
FIG. 2 shows a simplified flow diagram of a process according to a second embodiment of the invention, for producing liquid hydrocarbon products.

Referring to FIG. 2, reference numeral 100 generally indicates a process according to a second embodiment of the invention, for producing liquid hydrocarbon products.

In the process 100, components which are the same or similar to those of the process. 10 hereinbefore described with reference to FIG. 1, are indicated with the same reference numerals.

In the process 100, the heavy ends recovery stage 36 and the pressure swing adsorption stage 42 are dispensed with. Instead, a $CO_2$ removal step or stage 102 and a cryogenic separation step or stage 104 are provided.

Thus, the vapour phase flow line 34 from the product condensation stage 33 leads into the $CO_2$ removal stage 102. The third gas component withdrawal line 52 leads from the $CO_2$ removal stage 102 and is vented to the atmosphere.

A vapour phase transfer line 106 leads from the stage 102 to the cryogenic separation stage 104, with the first gas component line 44 and the second gas component line 46 leading from the stage 104.

It is believed that, in the process 100, efficient separations of the first, second and third gas components from one another can be achieved; however, it is also believed that capital costs and energy requirements may be higher than in the case of the process 10.

The Applicant is aware of processes for producing liquid hydrocarbon products and which include reforming a gaseous feedstock to synthesis gas in a reformer, reacting the synthesis gas in a Fischer-Tropsch synthesis stage, and separating an overheads vapour phase from, a liquid hydrocarbon product phase. The overheads vapour phase is separated into tail gas, water and hydrocarbon products. The tall gas is split, with a portion being recycled to the feedstock to the reformer, while the remainder is used as fuel gas.

However, such known processes have disadvantages such as

- residual tail gas from the Fischer-Tropsch synthesis stage, after optimization of vapour phase or tail gas recycle to the reformer, is often in excess of the fuel requirements;
- valuable $H_2$ and CO components in the tail gas are partially destroyed by recycling them to the reformer or completely destroyed by burning them in the fuel gas;
- tail gas recycle causes the build-up of inerts, which decreases the partial pressure of the reactants, ie $H_2$ and CO.

These disadvantages are avoided or overcome in the process of the present invention. For example, valuable $H_2$ and CO components in the tail gas are not destroyed, but are recycled to the Fischer-Tropsch synthesis stage. Furthermore, cost savings are realized in the process of the invention, and in particular in the Fischer-Tropsch synthesis stage 22, since it is possible to achieve, in the processes 10, 100, conversions which are equal to or better than those obtained in the known processes in respect of CO and $H_2$ to raw liquid products, using fewer or smaller Fischer-Tropsch reactors. Additionally, the ratio of raw liquid products to natural gas feed is increased. Still further, the cost of synthesis gas preparation per unit of reactants ($CO+H_2$) produced, is decreased. As a result, the economics of the processes 10, 100 are significantly improved as compared to the known processes.

Still further, in the case of autothermal reforming, recycle of $CO_2$ to the reformer can be avoided by decreasing the steam to reformable carbon ('s/c') ratio, typically to values between 0.2 and 0.6, depending on the natural gas composition. This can also be achieved using partial oxidation, but, as is required in known processes, oxygen consumption is higher due to the higher outlet temperatures, and additional $H_2$ recycle may then be needed to increase the $H_2$/CO ratio. The disadvantage of lower s/c ratios is that the methane conversion decreases unless the outer temperature of the reformer is increased above the typically recommended temperature of 900° C. to 1050° C. Increasing the outlet temperature is undesirable, since this consumes more oxygen. A further disadvantage of using lower s/c ratios without the present invention or high reformer outlet temperatures, is that if the tail gas from the hydrocarbon synthesis section is all routed to fuel gas, the fail gas availability then exceeds the fuel gas demand. Since plants for producing liquid hydrocarbons are often located in remote areas, there are usually no, or limited, alternative uses for the tail gas such as for generating electricity. It is due to these effects that the optimum reformer steam-to-carbon ratio in the known processes is generally higher than in the processes 10, 100, eg typically at about 0.6:1.

The invention thus provides a thermally efficient integrated process for the production of liquid hydrocarbons.

What is claimed is:

1. A process for producing liquid hydrocarbon products, which process includes converting, in a synthesis gas production stage, a natural gas feedstock comprising mainly $CH_4$ to synthesis gas comprising CO, $H_2$, $CO_2$ and $CH_4$;

feeding the synthesis gas, as a feedstock, to a hydrocarbon synthesis stage;

in the hydrocarbon synthesis stage, reacting the synthesis gas at elevated temperature and pressure, and in the presence of a Fischer-Tropsch catalyst, to produce a range of hydrocarbon products of differing carbon chain lengths, and separating an overheads vapour phase comprising gaseous hydrocarbon products, unreacted synthesis gas, water, and any soluble organic compounds which form in the hydrocarbon synthesis stage, from a liquid phase comprising heavier liquid hydrocarbon products;

withdrawing the liquid phase from the hydrocarbon synthesis stage;

withdrawing the overheads vapour phase from the hydrocarbon synthesis stage and feeding it to a product condensation stage, where condensation of at least some components of the overheads vapour phase takes place;

withdrawing from the product condensation stage a vapour phase comprising gaseous hydrocarbon products, an aqueous phase comprising water and said any soluble organic compounds which form in the hydrocarbon synthesis stage, and a condensed product phase comprising condensed hydrocarbon products;

feeding the vapour phase to a vapour phase work-up stage;

in the vapour phase work-up stage, recovering from the vapour phase a first gas component comprising increased concentrations of CO and $H_2$, relative to the vapour phase feed to the vapour phase work-up stage; and recycling the CO and $H_2$-containing first gas component to the hydrocarbon synthesis stage, as a feedstock component.

2. A process according to claim 1, wherein the conversion of the natural gas to synthesis gas in the synthesis gas production stage is effected by a reaction mechanism involving reacting hydrocarbonaceous material with steam and/or oxygen, with the reaction mechanism being selected from the group consisting in steam reforming, which does not require the use of oxygen; autothermal reforming, in which the hydrocarbonaceous material reacts with oxygen in a first reaction section, whereafter an endothermic steam reforming reaction takes place adiabatically in a second reaction section; ceramic oxygen transfer membrane reforming, in which oxygen required for the reforming reaction is transported through an oxygen permeable membrane into a reaction zone; plasma reforming in which the reforming reaction is driven by an electrically generated plasma; non-catalytic partial oxidation; catalytic partial oxidation; and two or more of these reaction mechanisms.

3. A process according to claim 1, wherein no $CO_2$ removal from the synthesis gas is effected, prior to the synthesis gas being fed as the feedstock to the hydrocarbon synthesis stage.

4. A process according to claim 1, wherein the hydrocarbon synthesis stage includes a reactor in which the synthesis gas is catalytically reacted by means of low temperature Fischer-Tropsch synthesis using a Co-based Fischer-Tropsch catalyst, with the reaction temperature being in the range of 200° C. to 280° C., with the main reactants being $H_2$ and CO, and with the $CO_2$ in the synthesis gas behaving as an inert gas in the reactor.

5. A process according to claim 4 wherein, in the vapour phase work-up stage, the vapour phase is separated into the first gas component comprising the increased concentrations of CO and $H_2$ a second gas component enriched in $CH_4$, and, optionally, a third gas component comprising mainly $CO_2$.

6. A process according to claim 5, wherein the third gas component is present, with the vapour phase work-up stage including a $CO_2$ removal step in which the third gas component is removed from the vapour phase, and a subsequent cryogenic separation step to which the residual vapour phase is subjected and in which the first gas component is cryogenically separated from the second gas component.

7. A process according to claim 5, wherein the third gas component is present, with the vapour phase work-up stage including a heavy ends recovery step in which hydrocarbon products having 3 or more carbon atoms, and which are present in the vapour phase, are removed from the vapour phase, and with the residual vapour phase then passing to a subsequent pressure swing adsorption step where it is separated into the first, second and third gas components, with the third gas component thus comprising mainly $CO_2$ and some light hydrocarbon products.

8. A process according to claim 7, wherein the second gas component is fed into a hydrogen production stage in which hydrogen is produced from the $CH_4$.

9. A process according to claim 8, wherein hydrogen produced in the hydrogen production stage is added to the synthesis gas feedstock to the hydrocarbon synthesis stage, thereby to increase the synthesis gas hydrogen content.

10. A process according to claim 7, which includes, in a liquid product upgrading stage, upgrading the liquid hydrocarbon products in the liquid phase withdrawn from the hydrocarbon synthesis stage as well as the hydrocarbon products in the condensed product phase from the product condensation stage, by hydroprocessing the hydrocarbon products using hydrogen from the hydrogen production stage.

11. A process for producing liquid hydrocarbon products, which process includes converting, in a synthesis gas production stage, a natural gas feedstock comprising mainly $CH_4$ to synthesis gas comprising CO, $H_2$, $CO_2$ and $CH_4$;

without removal of $CO_2$, feeding the synthesis gas, as a feedstock, to a hydrocarbon synthesis stage;

in the hydrocarbon synthesis stage, reacting the synthesis gas at elevated temperature and pressure, and in the presence of a Co-based Fischer-Tropsch catalyst, to produce a range of hydrocarbon products of differing carbon chain lengths, and separating an overheads vapour phase comprising gaseous hydrocarbon products, unreacted synthesis gas, water, and any soluble organic compounds which form in the hydrocarbon synthesis stage, from a liquid phase comprising heavier liquid hydrocarbon products;

withdrawing the liquid phase from the hydrocarbon synthesis stage;

withdrawing the overheads vapour phase from the hydrocarbon synthesis stage and feeding it to a product condensation stage, where condensation of at least some components of the vapour phase takes place;

withdrawing from the product condensation stage a vapour phase comprising gaseous hydrocarbon products, an aqueous phase comprising water and said any soluble organic compounds which form in the hydrocarbon synthesis stage, and a condensed product phase comprising condensed hydrocarbon products;

feeding the vapour phase to a heavy ends recovery stage;

in the heavy ends recovery stage, separating hydrocarbon products having 3 or more carbon atoms, from the vapour phase; and recycling at least a portion of the vapour phase from the heavy ends recovery stage to the synthesis gas production stage, as a feedstock component.

12. A process according to claim 11, wherein the conversion of the natural gas to synthesis gas in the synthesis gas production stage is effected by a reaction mechanism involving reacting hydrocarbonaceous material with steam and/or oxygen, with the reaction mechanism being selected from the group consisting in steam reforming, which does not require the use of oxygen; autothermal reforming, in which the hydrocarbonaceous material reacts with oxygen in a first reaction section, whereafter an endothermic steam reforming reaction takes place adiabatically in a second reaction section; ceramic oxygen transfer membrane reforming, in which oxygen required for the reforming reaction is transported through an oxygen permeable membrane into a reaction zone; plasma reforming in which the reforming reaction is driven by an electrically generated plasma; non-catalytic partial oxidation; catalytic partial oxidation; and two or more of these reaction mechanisms.

13. A process according to claim 11, wherein the hydrocarbon synthesis stage includes a reactor in which the synthesis gas is catalytically reacted by means of low temperature Fischer-Tropsch synthesis using the Co-based Fischer-Tropsch catalyst, with the reaction temperature being in the range of 200° C. to 280° C., with the main reactants being $H_2$ and CO, and with the $CO_2$ in the synthesis gas behaving as an inert gas in the reactor.

* * * * *